US008274242B2

(12) United States Patent
Chen et al.

(10) Patent No.: US 8,274,242 B2
(45) Date of Patent: Sep. 25, 2012

(54) POWER SUPPLY APPARATUS FOR AN LED LAMP

(75) Inventors: Chang-Hsing Chen, Taipei (TW); Sheng-Wei Chen, Taipei (TW)

(73) Assignee: Solytech Enterprise Corporation, Taipei (TW)

( * ) Notice: Subject to any disclaimer, the term of this patent is extended or adjusted under 35 U.S.C. 154(b) by 211 days.

(21) Appl. No.: 12/838,865

(22) Filed: Jul. 19, 2010

(65) Prior Publication Data

US 2012/0013269 A1 Jan. 19, 2012

(51) Int. Cl.
*H05B 37/02* (2006.01)

(52) U.S. Cl. ..... 315/307; 315/201; 315/228; 315/254

(58) Field of Classification Search ..... 363/19, 363/20, 21.18, 67, 80, 89, 127, 56, 132, 18, 363/21; 315/276, 312, 291, 244, 201, 228, 315/254

See application file for complete search history.

(56) References Cited

U.S. PATENT DOCUMENTS

| | | | | |
|---|---|---|---|---|
| 4,866,585 | A * | 9/1989 | Das | 363/8 |
| 5,914,865 | A * | 6/1999 | Barbehenn et al. | 363/21.15 |
| 6,490,177 | B1 * | 12/2002 | Figueroa | 363/21.03 |
| 7,928,664 | B2 * | 4/2011 | Beland | 315/276 |
| 2011/0309760 | A1 * | 12/2011 | Beland et al. | 315/201 |

* cited by examiner

*Primary Examiner* — Vibol Tan
(74) *Attorney, Agent, or Firm* — Rosenberg, Klein & Lee

(57) ABSTRACT

The present invention provides a power supply apparatus for an LED lamp, which mainly uses an isolation transformer to convert a high voltage AC input signal into a low voltage AC signal and thus generate a driving voltage for driving an LED lamp, comprising: a waveform and frequency modulation module disposed on the primary side of the isolation transformer for modulating an input waveform and a frequency f; and a secondary rectifier filter module disposed on the secondary side of the isolation transformer for converting the low voltage AC signal after passing through the isolation transformer into the driving voltage. In this way, the power supply apparatus for an LED lamp utilizes the principle of persistence of vision of human eyes to modulate the waveforms and frequencies of voltages for driving LEDs and can still maintain the normal operation.

7 Claims, 4 Drawing Sheets

POWER SUPPLY APPARATUS FOR AN LED LAMP

BACKGROUND OF THE INVENTION

1. Field of the Invention

The present invention relates to the field of power supply, and more particularly, to a power supply apparatus for an LED lamp, which utilizes the principle of persistence of vision of human eyes to modulate the waveforms and frequencies of voltages for driving LEDs and can still maintain the normal operation.

2. Description of the Related Art

As compared with conventional light sources, light emitting diodes (LEDs) have the advantages of operating at a low voltage, low power consumption and a long service life, etc. Therefore, in modern life, LEDs have been widely used in various related fields, where a light source is required, for example, applied to display backlight modules, indicating light sources, general lighting equipment, and the like. LEDs have the especially significant advantage of energy saving, so their practicability is particularly important in the most general purpose of lighting.

The principle of a traditional power supply for driving an LED lamp is mainly that an inputted high voltage alternating current is rectified, filtered and then converted by a transformer into a low voltage alternating current then being processed by a rectifier and an electrolytic capacitor filter circuit into a stable voltage DC output for driving corresponding LED lamps. The prior art uses large capacitance characteristics of electrolytic capacitors to reduce the occurrence of ripples and thus to achieve a stable voltage DC output. However, most external environmental factors will deteriorate the performance of electrolytic capacitors such that electrolytic capacitors typically have a shorter life than other types of capacitors. Among environmental factors, temperature has the most tremendous impact on the life of electrolytic capacitors, and for example, the intense heat caused by ripple currents is one of the reasons. The intense heat will accelerate the performance deterioration of electrolytic capacitors to reduce the life and static capacity to only a fraction of the original, and thus the capacitors are tantamount to having no filter capacitor function. Therefore, even if an LED lamp has a longer life, there is no filter capacitor to effectively match the longer life for the normal operation of the LED lamp.

In view of the above-described circumstances, the inventors conducted elaborate research with accumulated years of experience in this field, so as to develop a power supply apparatus for an LED lamp, which mainly utilizes the principle of persistence of vision of human eyes to modulate the waveforms and frequencies of voltages for driving LEDs and can still maintain the normal operation. Also, with no need to convert an AC voltage into a stable DC output as in the prior art, the present invention uses a longer life non-electrolytic capacitor for wave filtering to control the waveforms and frequencies of any voltages outputted to an LED lamp to be greater than or equal to 60 Hertz and control peak-to-peak values of ripple signals to be greater than or equal to 1 volt. Furthermore, feedback control facilitates to maintain the output within the operating range so as to effectively drive the LED lamp, thus improving the overall service life of the LED lamp.

SUMMARY OF THE INVENTION

In view of the above-mentioned problems, an object of the present invention is to provide a power supply apparatus for an LED lamp, which utilizes the principle of persistence of vision of human eyes to modulate the waveforms and frequencies of voltages for driving LEDs and can still maintain the normal operation.

To achieve the foregoing objects, there is provided a power supply apparatus for an LED lamp, which mainly uses an isolation transformer to convert a high voltage AC input signal into a low voltage AC signal and thus generate a driving voltage for driving an LED lamp, comprising: a waveform and frequency modulation module disposed on the primary side of the isolation transformer for modulating an input waveform and a frequency f, wherein the frequency f is $\geqq 60$ Hz; and a secondary rectifier filter module disposed on the secondary side of the isolation transformer for converting the low voltage AC signal after passing through the isolation transformer into the driving voltage, wherein the driving voltage is a low voltage ripple signal and a peak-to-peak value $\Delta V$ of the low voltage ripple signal is $\geqq 1$.

The waveform and frequency modulation module comprises a switching element and a PWM control circuit. The secondary rectifier filter module comprises a secondary rectifier circuit and a secondary filter circuit, wherein the secondary filter circuit has a non-electrolytic capacitor to increase the service life. For example, the non-electrolytic capacitor is a metallized polymer film capacitor or a Mylar capacitor.

In order to allow continuous stable output of the driving voltage, the power supply apparatus for an LED lamp according to the present invention may further comprise: a feedback control module disposed on the secondary side of the isolation transformer and connected to the secondary rectifier filter module for controlling the waveform and frequency modulation module on the primary side of the isolation transformer in a feedback manner. The feedback control module has a feedback circuit, an integration circuit and a photocoupler.

In order to enhance the voltage stabilization effect after the modulation, the power supply apparatus for an LED lamp according to the present invention may further comprise: a primary rectifier filter module disposed on the primary side of the isolation transformer for rectifying and filtering the high voltage AC signal and then transmitting the high voltage AC signal to the waveform and frequency modulation module.

The effect of the present invention is that the principle of persistence of vision of human eyes is mainly utilized to modulate the waveforms and frequencies of voltages for driving LEDs while the normal operation can still be maintained. Also, with no need to convert an AC voltage into a stable DC output as in the prior art, the present invention uses a longer life non-electrolytic capacitor for wave filtering to control the waveforms and frequencies of any voltages outputted to an LED lamp to be greater than or equal to 60 Hertz and control peak-to-peak values of ripple signals to be greater than or equal to 1 volt. Furthermore, feedback control facilitates to maintain the output within the operating range so as to effectively drive the LED lamp, thus improving the overall service life of the LED lamp.

DETAILED DESCRIPTION OF THE PREFERRED EMBODIMENTS

The contents of the present invention will become more apparent from the following description when taken in conjunction with the drawings.

Figure 1:
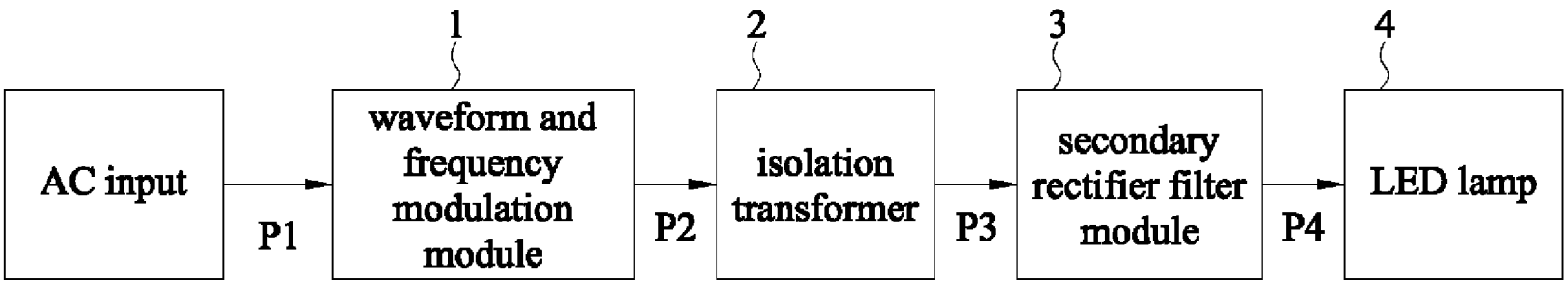
FIG. 1 is a schematic block diagram of a first preferred embodiment of a power supply apparatus for an LED lamp according to the present invention.

Referring to FIG. 1, there is shown a schematic block diagram of a first preferred embodiment of a power supply apparatus for an LED lamp according to the present invention. As can be seen in this figure, a power supply apparatus for an LED lamp is provided in this embodiment, which mainly uses an isolation transformer 2 to convert a high voltage AC input signal into a driving voltage for driving an LED lamp, comprising: a waveform and frequency modulation module 1 and a secondary rectifier filter module 3. The waveform and frequency modulation module 1 is disposed on the primary side of the isolation transformer 2 for modulating an input waveform and a frequency f, wherein the frequency f is ≧60 Hz. By means of the waveform and frequency modulation module 1, the present invention is applicable to any types of pulse waveforms that are used to drive the LED lamp 4. For example, all of triangular, rectangular (square) or sinusoidal waves can be the pulse waveforms of the driving voltage of the present invention. The modulation for the frequency f≧60 Hz enables the effect of persistence of vision of human eyes. Therefore, after the high voltage AC input signal is modulated by the waveform and frequency modulation module 1 on the primary side, the isolation transformer 2 converts the voltage into a low voltage AC signal. At this time, the low voltage AC signal passes through the secondary rectifier filter module 3 and is converted into the driving voltage. The driving voltage is a low voltage ripple signal, and a peak-to-peak value ΔV of the low voltage ripple signal is ≧1, so that the LED lamp can be effectively driven to improve the overall service life of the LED lamp.

Figure 2:
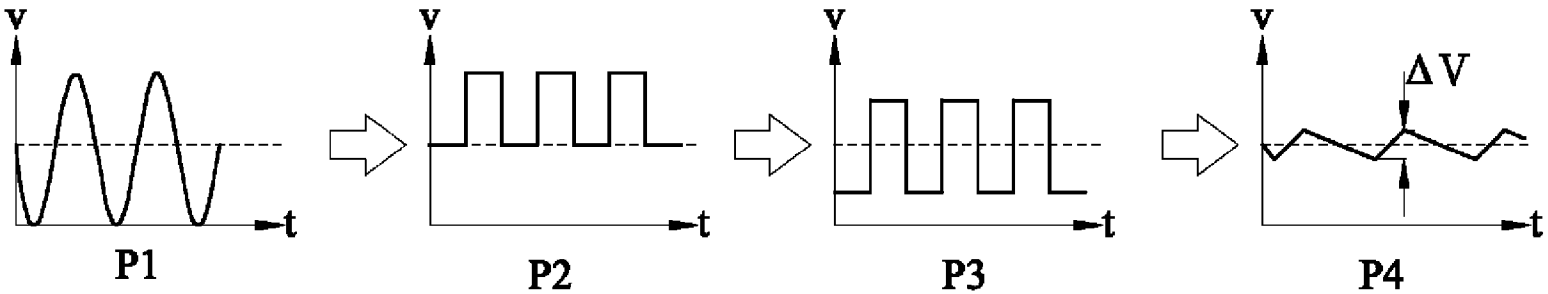
FIG. 2 is a graph showing changes in the waveforms of a first preferred embodiment of a power supply apparatus for an LED lamp according to the present invention.

Also referring to FIG. 2, there is shown a graph showing changes in the waveforms of a first preferred embodiment of a power supply apparatus for an LED lamp according to the present invention. "P1 to P4" in FIG. 2 are graphs showing the voltage waveforms after modulated in each stage. As changing with time, the P1 shows the waveform of a high voltage AC signal that has not been modulated yet; the P2 shows the waveform of the high voltage AC signal that has been modulated by the waveform and frequency modulation module 1. The waveform and frequency modulation module 1 comprises a switching element 10 and a PWM control circuit 12 (with reference to FIG. 4). Thus, a sinusoidal wave can be modulated into a rectangular (square) wave, and the duty cycle is changed so that the value of the output frequency f is controlled under the condition of f≧60 Hz. Next, the P3 shows the waveform of the low voltage AC signal that has been modulated on the secondary side of the isolation transformer 2; finally, the P4 shows the waveform of the driving voltage that has been modulated by the secondary rectifier filter module 3 and is a low voltage ripple signal. Since the function of the secondary rectifier filter module 3 is to tend to flatten out the waveform of the P3 but with no need to achieve a DC output with a stable fixed value, the secondary rectifier filter module 3 may comprise a secondary rectifier circuit 30 and a secondary filter circuit 32. The secondary filter circuit 32 has a non-electrolytic capacitor. The life of a non-electrolytic capacitor is longer than that of an electrolytic capacitor. The selected capacitance of the non-electrolytic capacitor is comparatively low with the ease to generate ripples. However, due to the principle of persistence of vision of human eyes, the ripple signals with a suitable driving frequency and a suitable peak-to-peak value ΔV, i.e., the driving voltages of the present invention, can still effectively drive the LED lamp 4 with no need to stably output a fixed DC voltage, so as to significantly improve the overall service life of the LED lamp. Moreover, a metallized polymer film capacitor or a Mylar capacitor may be selected as the non-electrolytic capacitor in the implementation of the invention.

Figure 3:
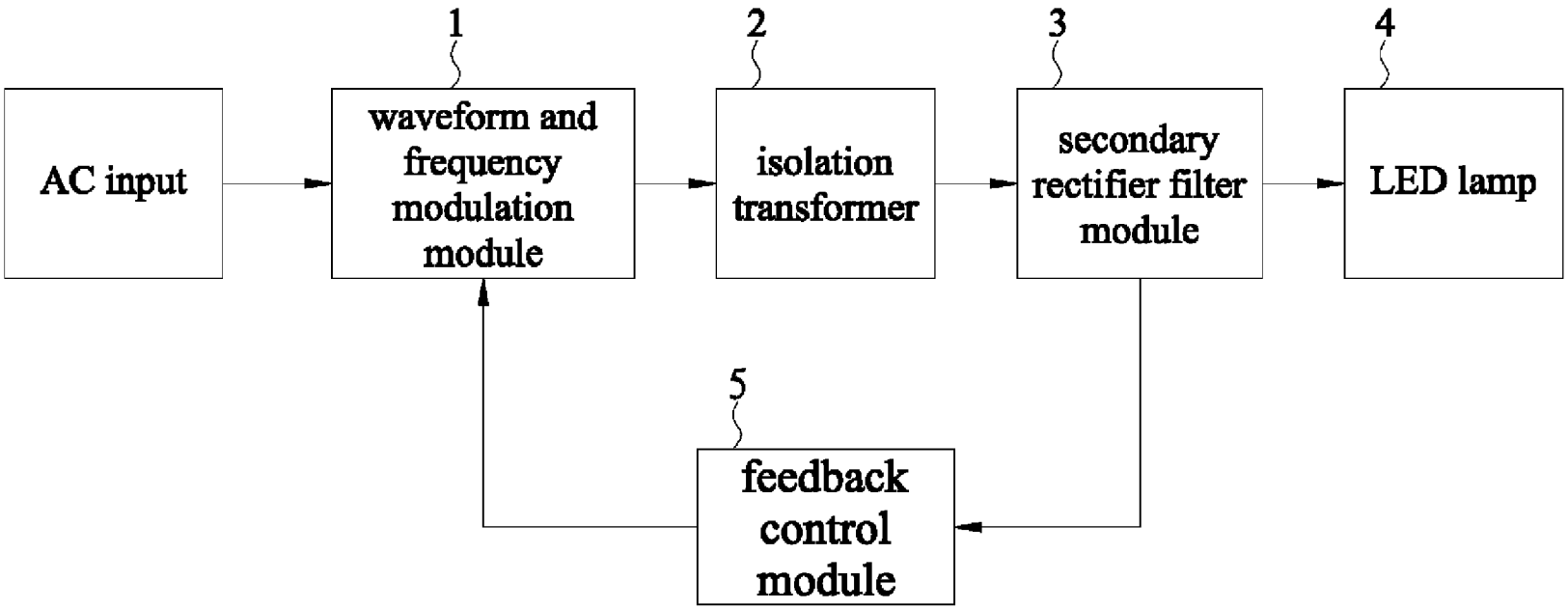
FIG. 3 is a schematic block diagram of a second preferred embodiment of a power supply apparatus for an LED lamp according to the present invention.

Referring to FIG. 3, there is shown a schematic block diagram of a second preferred embodiment of a power supply apparatus for an LED lamp according to the present invention. As compared with the first embodiment, the power supply apparatus in this embodiment further comprises a feedback control module 5 for allowing continuous stable output of the driving voltage to effectively drive the LED lamp 4. The feedback control module 5 is disposed on the secondary side of the isolation transformer 2 and connected to the secondary rectifier filter module 3 for controlling the waveform and frequency modulation module 1 on the primary side of the isolation transformer 2 in a feedback manner. The feedback control module 5 has a feedback circuit 50, an integration circuit 52 and a photocoupler 54 (with reference to FIG. 4). The voltage average value can be found out via the integration circuit 52 to enable more accurate feedback control. The photocoupler 54 can transmit signals and can achieve the purpose of electrical shielding. In operation, the photocoupler 54 controls a constant voltage or constant current feedback signal on the secondary side in a feedback manner as a reference signal for modulation. For example, when the voltage of the photocoupler 54 reaches a specified voltage, it sends a signal back to turn off the PWM control circuit 12 (i.e., the output is zero).

Figure 4:
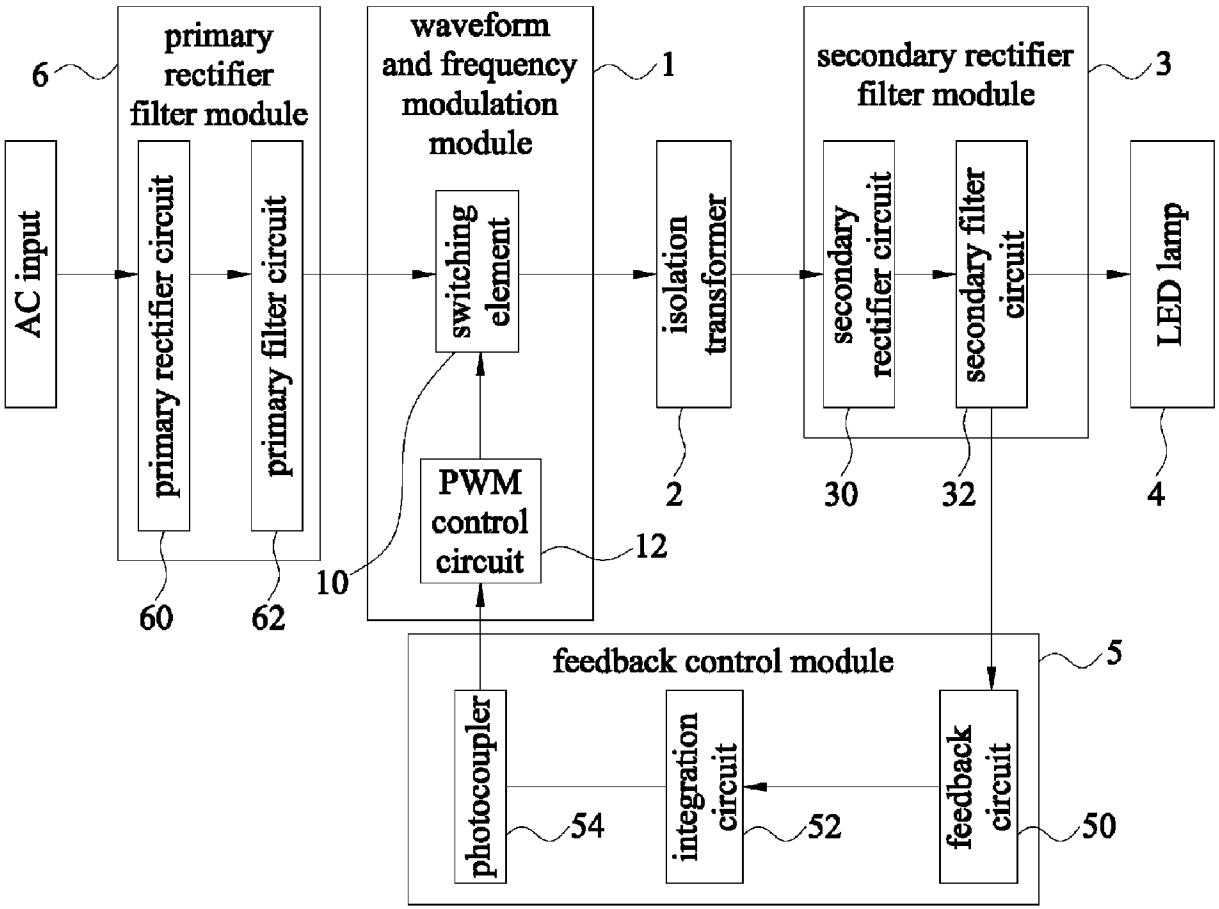
FIG. 4 is a schematic block diagram of a third preferred embodiment of a power supply apparatus for an LED lamp according to the present invention.

Referring to FIG. 4, there is shown a schematic block diagram of a third preferred embodiment of a power supply apparatus for an LED lamp according to the present invention. Under the architecture of the second embodiment, the power supply apparatus in this embodiment further comprises a primary rectifier filter module 6 disposed on the primary side of the isolation transformer 2 for rectifying and filtering the high voltage AC signal and then transmitting it to the waveform and frequency modulation module 1. The purpose of the primary rectifier filter module 6 is to enhance the voltage stabilization effect after the modulation. As the same as the secondary rectifier filter module 3, the primary rectifier filter module 6 may comprise a primary rectifier circuit 60 and a primary filter circuit 62. The primary filter circuit 62 has a non-electrolytic capacitor. The non-electrolytic capacitor may be a metallized polymer film capacitor or a Mylar capacitor. The purpose of selection of the elements of the primary filter circuit 62 is the same as that of the secondary filter circuit 32 as described above and thus will be explained in no more detail. The primary rectifier circuit 60 may be a bridge rectifier, which rectifies the full wave of the high voltage AC signal and then filters the waveform. The subsequent operation is the same as those in the first and second embodiments and thus will also be explained in no more detail.

The effect of the present invention is that the principle of persistence of vision of human eyes is mainly utilized to modulate the waveforms and frequencies of voltages for driving LEDs while the normal operation can still be maintained. Also, with no need to convert an AC voltage into a stable DC output as in the prior art, the present invention uses a longer life non-electrolytic capacitor for wave filtering to control the waveforms and frequencies of any voltages outputted to an LED lamp to be greater than or equal to 60 Hertz and control peak-to-peak values of ripple signals to be greater than or equal to 1 volt. Furthermore, feedback control facilitates to maintain the output within the operating range so as to effectively drive the LED lamp, thus improving the overall service life of the LED lamp.

However, what are described above are only preferred embodiments of the invention and should not be used to limit the claims of the present invention; the above description can be understood and put into practice by those who are skilled in the present technical field, and therefore all equivalent changes and modifications made without departing from the spirit and scope of the present invention should be included in the appended claims.

What is claimed is:

1. A power supply apparatus for an LED lamp using an isolation transformer to convert a high voltage AC input signal into a low voltage AC signal and thus generate a driving voltage for driving an LED lamp, comprising:

a waveform and frequency modulation module disposed on the primary side of the isolation transformer for modulating an input waveform and a frequency f, wherein the frequency f is $\geqq 60$ Hz;

a secondary rectifier filter module disposed on the secondary side of the isolation transformer for converting the low voltage AC signal after passing through the isolation transformer into the driving voltage, wherein the driving voltage is a low voltage ripple signal and a peak-to-peak value $\Delta V$ of the low voltage ripple signal is $\geqq 1$ V; and the secondary rectifier filter module comprises a secondary rectifier circuit and a secondary filter circuit, and the secondary rectifier filter circuit has a non-electrolytic capacitor, wherein the non-electrolytic capacitor is a metalized polymer film capacitor or a Mylar capacitor.

2. The power supply apparatus for an LED lamp as set forth in claim 1, further comprising: a feedback control module disposed on the secondary side of the isolation transformer and connected to the secondary rectifier filter module for controlling the waveform and frequency modulation module on the primary side of the isolation transformer in a feedback manner.

3. The power supply apparatus for an LED lamp as set forth in claim 2, wherein the feedback control module has a feedback circuit, an integration circuit and a photocoupler.

4. The power supply apparatus for an LED lamp as set forth in claim 2, further comprising: a primary rectifier filter module disposed on the primary side of the isolation transformer for rectifying and filtering the high voltage AC signal and then transmitting the high voltage AC signal to the waveform and frequency modulation module.

5. The power supply apparatus for an LED lamp as set forth in claim 4, wherein the primary rectifier filter module comprises a primary rectifier circuit and a primary filter circuit and wherein the primary filter circuit has a non-electrolytic capacitor.

6. The power supply apparatus for an LED lamp as set forth in claim 5, wherein the non-electrolytic capacitor is a metalized polymer film capacitor or a Mylar capacitor.

7. The power supply apparatus for an LED lamp as set forth in claim 5, wherein the primary rectifier circuit is a bridge rectifier.

* * * * *